United States Patent [19]

Worth

[11] Patent Number: 4,701,133

[45] Date of Patent: Oct. 20, 1987

[54] HERMAPHRODITIC CONNECTOR

[75] Inventor: Sidney V. Worth, Flourtown, Pa.

[73] Assignee: Continental-Wirt Electronics Corporation, Southampton, Pa.

[21] Appl. No.: 5,705

[22] Filed: Jan. 21, 1987

[51] Int. Cl.[4] ..... H01R 13/28; H01R 25/00; H01R 39/00

[52] U.S. Cl. ..... 439/13; 439/288; 439/292

[58] Field of Search ..... 339/4, 8 R, 8 A, 47 R, 339/49 R, 91 R, 17 L, 17 LM, 17 LC, 6 R, 6 A

[56] References Cited

U.S. PATENT DOCUMENTS

| | | | |
|---|---|---|---|
| 3,601,746 | 8/1971 | Teagno | 339/4 |
| 4,632,475 | 12/1986 | Tomita | 339/4 |
| 4,657,320 | 4/1987 | Bamford et al. | 339/4 |

FOREIGN PATENT DOCUMENTS

| | | | |
|---|---|---|---|
| 1221836 | 1/1960 | France | 339/49 R |

*Primary Examiner*—Eugene F. Desmond

*Attorney, Agent, or Firm*—Caesar, Rivise, Bernstein, Cohen & Pokotilow, Ltd.

[57] ABSTRACT

A hermaphroditic electrical connector comprising a pair of substantially identical body members releasably secured together to electrically connect plural electrical contacts of one member to respective electrical contacts of the other member and for maintaining such electrical connections while enabling the two connector members to be pivoted with respect to each other about a longitudinal axis through a predetermined angular range. The means for securing the two connector members together comprise a post and a recess on each body member aligned with the longitudinal axis to enable the post of one member to be readily snap-fit within the recess of the other member. Each of the two body members includes spaced-apart ribs which, when the two members are connected together, are interleaved to define plural internal spaces. Each space houses a pair of engaging contacts and is generally isolated from the ambient atmosphere. Each contact includes a post section, an anchoring section, and cantilever sections of the contacts serve as the means for effecting the electrical connection between them. To that end, each cantilever section includes a generally planar engagement surface disposed generally perpendicularly to the longitudinal axis of the connector and contiguous therewith. When the two body members are brought together, their cantilever sections deflect somewhat and the engagement surfaces of the contacts make good electrical connection with each other over a relatively large area irrespective of the angular orientation between the two body members.

22 Claims, 6 Drawing Figures

HERMAPHRODITIC CONNECTOR

BACKGROUND OF THE INVENTION

This invention relates generally to electrical connectors and more particularly to multiple contact connectors having two portions which are readily releasably securable to one another and which can be pivoted with respect to each other while maintaining good electrical contact therebetween.

In most types of electrical or electronic equipment today, it is standard practice to effect the interconnection of portions of the electrical circuitry of the equipment to each other or to associated or auxiliary equipment through the use of multiple-contact, electrical connectors. Such connectors commonly comprise a pair of connector members or bodies, each including plural electrical contacts, which are electrically connected to respective portions of the equipment either directly or through the use of cables. The two connector bodies are adapted to be releasably secured together so that the contacts of one body member electrically engage respective contacts of the other member.

In many instances, it is desirable to move the contact members with respect to each other while maintaining the electrical continuity of their contacts. Such action may be desirable in order to gain easy access to portions of the associated equipment or to adjust the connector to a desired orientation to accommodate the physical constraints of the equipment's housing, support or environment.

That need has not heretofore been satisfactorily fulfilled by prior art connectors which are simple in construction, can be connected and disconnected from each other readily, are effective in operation and suitable for long term, reliable operation.

OBJECTS OF THE INVENTION

Accordingly, it is the general object of the instant invention to provide an electrical connector which overcomes the deficiencies of the prior art.

It is a further object of this invention to provide an electrical connector comprising two components which can be readily secured to each other to effect the electrical interconnection of plural contacts therein, irrespective of the orientation between the connectors.

It is a further object of this invention to provide an electrical connector having a pair of body members arranged to be releasably secured to each other and oriented in any angular orientation within a predetermined angular range, with the electrical contacts of those members being constructed to facilitate their interconnection with a low insertion force, while ensuring that the contacts maintain good electrical contact with each other irrespective of the angular orientation of the body members.

It is still a further object of this invention to provide an electrical connector having a pair of body members including means for readily snap-fitting the two members together while enabling them to be pivoted with respect to each other through a predetermined angular range and without resulting in damage to the connector members.

It is still a further object of this invention to provide an electrical connector comprising a pair of body members each including plural contacts therein and arranged to be interconnected so that the contacts are effectively isolated from the ambient atmosphere while enabling the two members to be pivoted with respect to each other.

It is still a further object of the instant invention to provide an electrical connector including a pair of body members arranged to be releasably secured in a pivotable arrangement to each other and formed of a material which is resistant to high temperature.

It is still a further object of the instant invention to provide an electrical connector including a pair of body members each including plural contacts having relatively large engagement surfaces which engage each other to prevent excessive current density therethrough while enabling connection and disconnection with relatively low insertion and withdrawal forces, respectively.

These and other objects of the instant invention are achieved by providing a electrical connector comprising a pair of body members. In a preferred embodiment, each body member is hermaphroditic and includes plural electrical contacts. The body members are adapted to be readily secured to each other so that respective ones of the contacts of one member engage respective ones of the contacts of the other member in good electrical conductivity. The body members include means to enable them to be pivoted with respect to one another about a longitudinal axis through a predetermined angular range, while still maintaining good electrical conductivity between their contacts.

Each body member basically comprises a base portion including plural ribs projecting upward therefrom. When the connector members are secured together, their rib portions are interleaved and define therebetween plural internal spaces, with one electrical contact of one member and the corresponding electrical contact of the other member being located in each of the spaces. Each of the contacts comprises a cantilever portion having an engagement portion in the form of a surface disposed contiguous with the longitudinal axis. The cantilever portions are arranged to deflect when the two connector members are brought together, thereby facilitating the securement contacts and with their engagement surfaces in good electrical contact with each other irrespective of the angular orientation of one body member to the other about the longitudinal axis.

In accordance with a preferred aspect of the invention, each contact, in addition to the cantilever portion, includes an anchoring portion fixedly secured to the associated body member and a post extending out of the body member. The post serves as a terminal for connection to associated components. The cantilever portion is preferably formed of a strip of material defining a free end or nose portion, the heretofore identified engagement portion, and an arm portion. The engagement surface is preferably planar. The nose and arm portions of each contact are constructed to enable them to flex readily to facilitate the securement of the body members together, while ensuring that the plane of the engagement surface of each contact of one member remains parallel to the engagement surface of the corresponding contact of the other member.

In accordance with another preferred aspect of this invention, the means for connecting the two body members together basically comprises a pair of upstanding arms disposed at one end of each body member and which define a generally circular recess of a predetermined radius therebetween and a post disposed on a rib member at the other end of each body member. The post and recess are aligned on the longitudinal axis of the connector. The post preferably includes at least two arcuate portions, each defining an arc of a circle of the predetermined radius and disposed concentrically about the longitudinal axis so that the post of one body member can be readily snap-fit within the recess of the other body member, and vice versa.

In accordance with yet another preferred aspect of this invention, each of the ribs are constructed so as to substantially enclose the contacts of the two body members within respective internal spaces therein. Thus, each of the ribs is an elongated member extending transversely to the longitudinal axis of the connector and having a pair of ends. Each end of each rib includes an enlarged width flange portion. The spacing between the enlarged widthflange portions of immediately adjacent ribs is just slightly larger than the width of the flange portions themselves, whereupon when the two body members are connected together and their ribs interleaved, the flange portions of the ribs of one member are disposed within and substantially fill the spaces between the flange portions of the ribs of the other member, thereby enclosing the contacts within the respective spaces within the connector's body members.

DESCRIPTION OF THE DRAWING

Other objects and many of the attendant advantages of the invention will be readily appreciated as the same becomes better understood by reference to the following detailed description when considered in connection with the accompanying drawing wherein.

DETAILED DESCRIPTION OF THE PREFERRED EMBODIMENT

Figure 1:
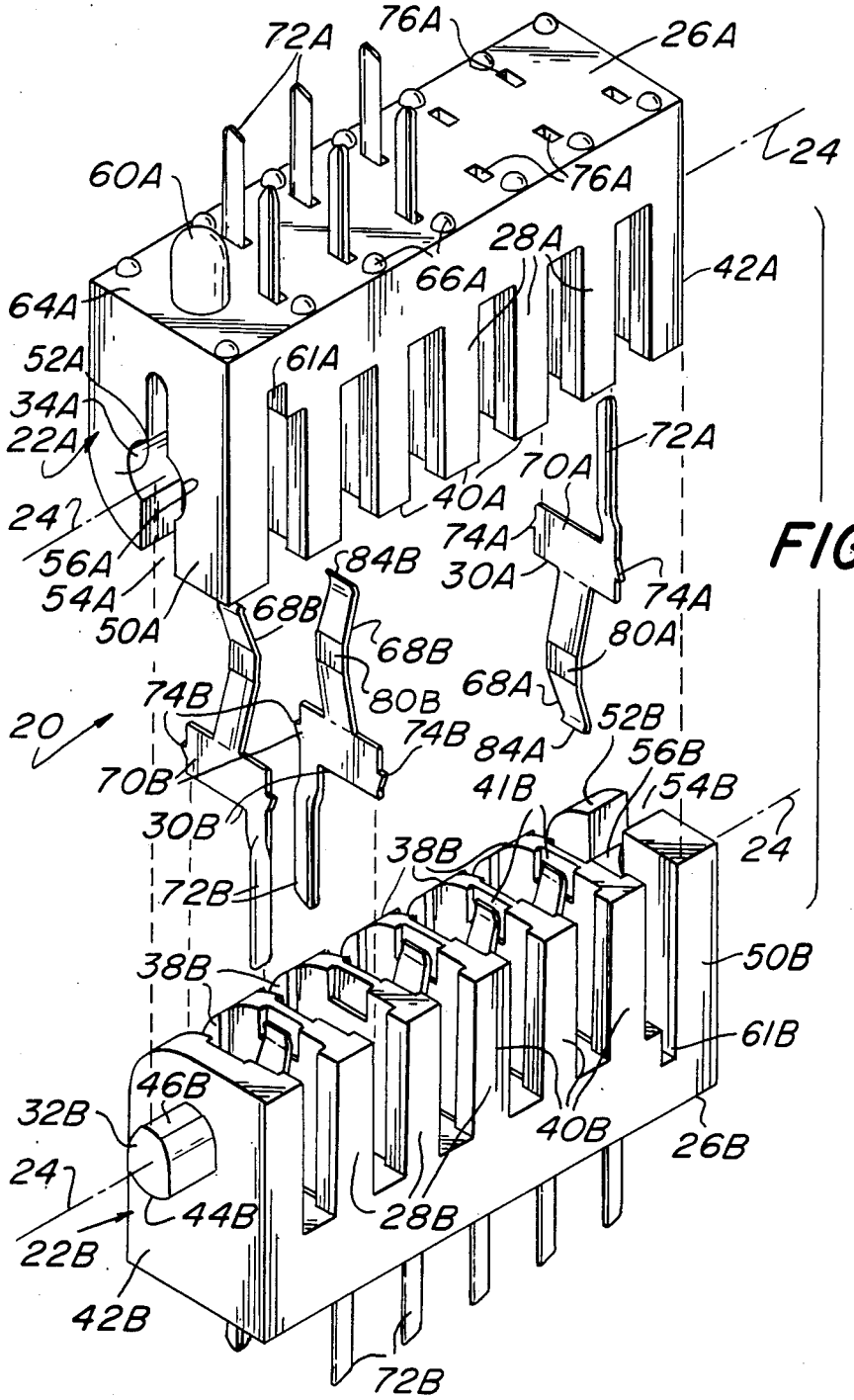
FIG. 1 is an exploded, perspective view of a pivotable, hermaphroditic connector constructed in accordance with the subject invention.
Figure 2:
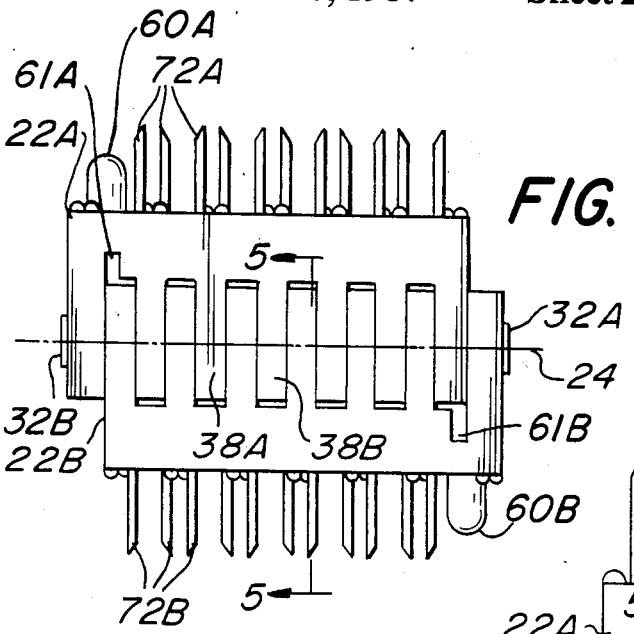
FIG. 2 is a front (or rear) elevational view of the connector shown in FIG. 1, but shown assembled.

Referring now to the various figures of the drawing wherein like reference characters refer to like parts, there is shown at 20 in FIG. 1 a hermaphroditic, pivotable connector constructed in accordance with the instant invention. The connector 20 basically comprises a pair of identical body members or sections 22A and 22B. The two body members are arranged to be releasably secured to each other to effect the ready electrical interconnection of plural electrical contacts, to be described later, located within them, while enabling the two members to be pivoted with respect to each other through a predetermined angular range about a longitudinal axis 24 extending through the connector. In the embodiment shown herein the two connector sections 22A and 22B are configured to be pivoted through an angular range of up to 90° about axis 24. However, it should be pointed out that by appropriate construction of the members 22A and 22B they may be enabled to pivot through angles in excess of 90°.

Inasmuch as the two connector members 22A and 22B are of identical construction in a preferred embodiment of this invention their corresponding components or elements will be referred to by the same reference numerals, except for the suffix designation "A" or "B" to indicate the connector of which the reference component is a part. Moreover, in the interest of expediting the explanation of the structure and operation of the connector 20 reference may be made to a component part of both 22A and 22B. In such a case, the component will be described with the suffix A/B while the particular component shown in the drawing will bear a reference number having either an A or B suffix.

It should be pointed out at this juncture that the two body members need not be identical in construction in all aspects as shown herein so long as their major functional components (to be described later) are similar.

As can be ssen in FIG. 1, each body member basically comprises a base portion 26 A/B, plural upstanding ribs 28 A/B, plural electrical contacts 30 A/B, and releasably securable connecting means in the form of a post 32 A/B, and an axially aligned arcuate recess 34 A/B.

Figure 6:
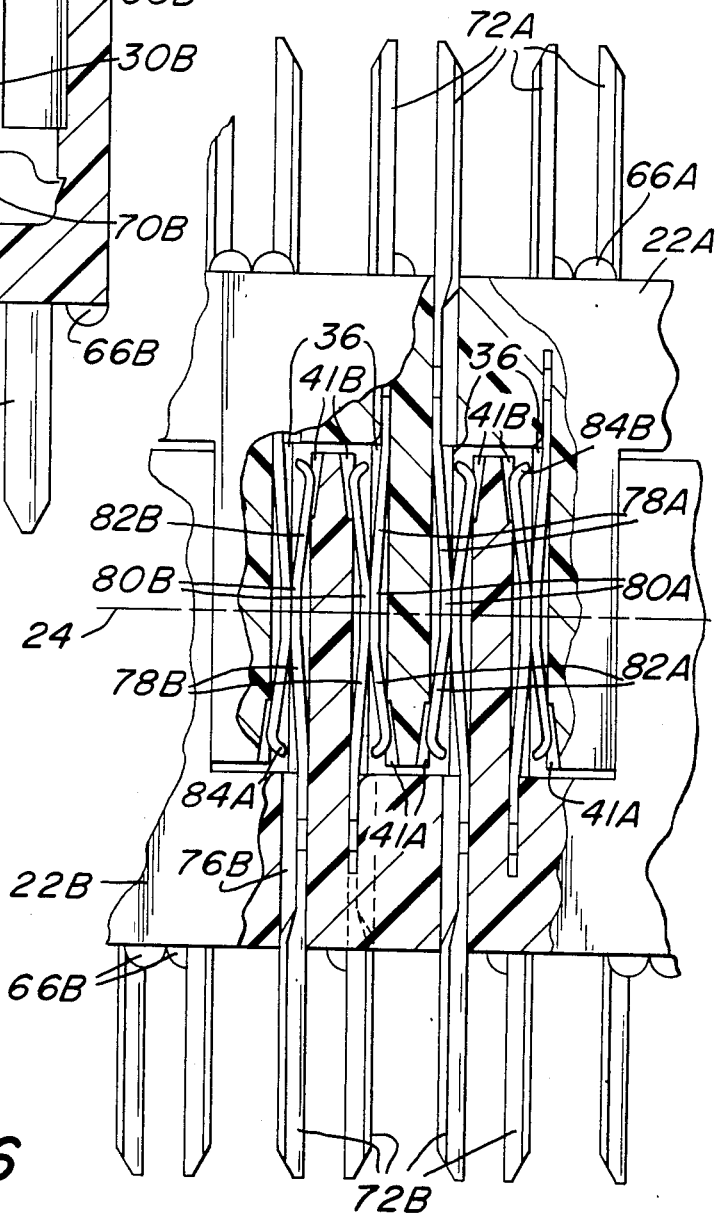
FIG. 6 is an enlarged sectional view taken along line 6—6 of FIG. 5.

The details and operation of the two body members 22A and 22B will be described in considerable detail later. Suffice for now to state that the two members are arranged to be releasably secured so that the ribs of one member are interleaved with the ribs of the other member to form respective internal spaces or chambers 36 (FIG. 6) therebetween. Disposed within each space 36 is a cantilever portion of the contact of one member and a cantilever portion of the corresponding contact of the other member. Those cantilever portions of the contacts each include a respective engagement surface which engage each other in good electrical contact contiguous with the axis 24 irrespective of the angular orientation of the two members 22 A/B with respect to axis 24.

As can be seen, the base portion 26 A/B of the members 22 A/B is an elongated, generally rectangular structure whose major dimension extends parallel to the longitudinal axis 24. The ribs 28 A/B are in the form of projecting (i.e., upstanding or downstanding) planar wall-like members extending transversely across the base portion, that is, transverse to axis 24. Each rib includes a pair of ends 38 A/B and 40 A/B each in the form of a flange. The flanges 38 A/B and 40 A/B are substantially wider than the thickness of the ribs themselves, but slightly less than the spacing between the flanges of immediately adjacent ribs. Accordingly, when the two body members 22A and 22B are secured together and their ribs 28 A/B are interleaved, the flanges 38A substantially fill the spaces between the flanges 38B on one side of the two interconnected body members while the flanges 40A substantially fill the spaces between the flanges 40B on the other side of the body members. Accordingly, very little space (e.g., 0.001") is provided between the interleaved flanges at the end of the ribs through which dirt or debris from the ambient atmosphere may pass to gain ingress into the internal spaces 36 having the contacts located therein.

As can be seen clearly in FIGS. 1, 4, 5 and 6, a tapered recess 41 A/B is provided in each surface of the ribs 28 A/B contiguous with the top thereof. These recesses serve to receive the free end or nose portion of the contacts 30 A/B (to be described later) during the securement of the two members 22 A/B together.

Figure 3:
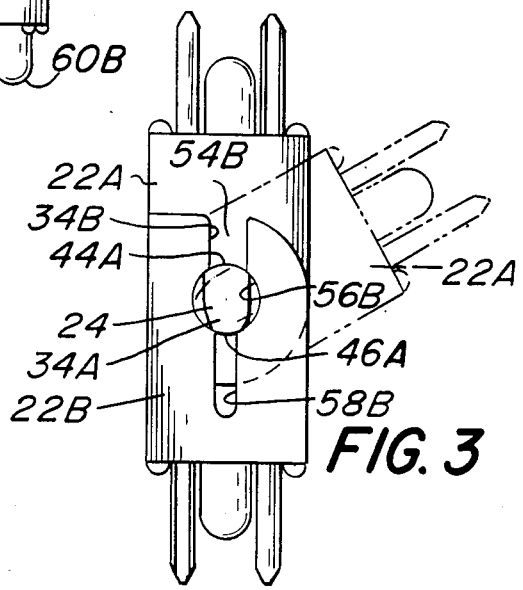
FIG. 3 is an enlarged end view of the connector shown in FIG. 2 and with the phantom lines depicting one exemplary angular orientation of the connector.
Figure 4:
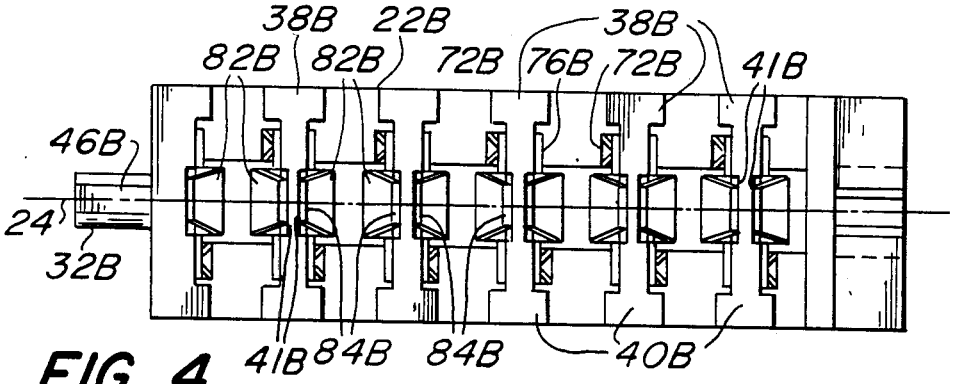
FIG. 4 is an enlarged top plan view of one portion of the connector shown in FIG. 1.
Figure 5:
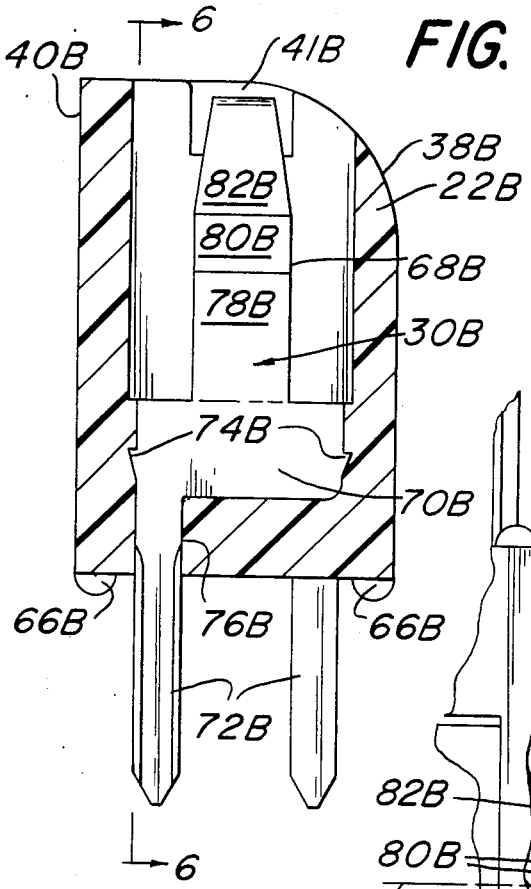
FIG. 5 is an enlarged sectional view taken along line 5—5 of FIG. 2.

As noted earlier, the means for releasably securing the two body members together comprise a post 32 and an axially aligned recess 34 on each body member. The post of one body member is arranged to be received within the recess of the other body member, and vice versa, to secure the two members together in a pivotable arrangement. Thus, as can be seen clearly in FIGS. 1, 3 and 4, the post 32 A/B is mounted on a rib-like wall 42 A/B at one end of the base 26 A/B. The wall 42 A/B is somewhat similar in construction to the ribs 28 except that it is thicker. The post 34 A/B projects outward from the outside face of the wall 42 A/B centered on axis 24 and basically comprises a pair of arcuate surfaces 44 A/B and 46 A/B. Each surface constitutes a portion of an arc of a circle of a predetermined radius, but the length of the arc of surface 44B being substantially greater than the length of the arc of surface 46B (as shown clearly in FIGS. 1 and 3). The smaller width of arcuate surface 46B enables it to be readily inserted into recess 34A, as will be described later, to expedite the connection of the two members 22A and 22B together. The outer surface 48 A/B of the post 34 A/B between the circular arcuate surfaces 44 A/B and 46 A/B is in the form of a relieved arc to further expedite the securement of the two members together.

The recess 34 A/B is formed by a pair of spaced arms 50 A/B and 52 A/B which project upward (or downward) from the base 26 A/B at the opposite end from wall 42 A/B. The spacing between the arms defines the recess 34 A/B. Thus, as can be seen clearly in FIGS. 1 and 3, the recess 32 basically comprises an enlarged width entrance mouth 54 A/B opening to a generally circular arcuate portion 56 A/B. The radius of the arcuate portion 56 A/B is substantially the same or slightly greater than the radius of the circle defining the arcuate surfaces 44 A/B and 46 A/B. the recess 32 A/B also includes a narrow slot 58 A/B disposed below the arcuate portion 56 A/B, that is, between the arcuate portion 56 A/B and the member's base 26 A/B.

The width of the entrance mouth 54 A/B is greater than the width of the arcuate surface 46 A/B to enable the post to be readily inserted therein. Moreover, the arms 50 A//B and 52 A/B are made sufficiently long, by a transverse slot in the base (to be described later) to enable them to more readily flex apart so that the post 34 A/B can pass therebetween into the arcuate recess 56 A/B. Since the recess 56 A/B is of circular profile, whose radius is the same or slightly greater than the radius of the circle defining the post's arcuate surfaces 44 A/B and 46 A/B the post can freely rotate within the recess about axis 24. The slot 58 A/B serves to take up any stress as created during the connection and thus prevent the connector's arms 50 A/B and 52 A/B from splitting apart. Also, the interface of the stress relief slot 58 A/B and the arcuate recess 56 A/B serves as a stop to prevent the post from being inserted too deeply into the recess 34 A/B, and offers a relatively large pivotal bearing surface.

As can be seen, the top of the arms 50 A/B and 52 A/B are coextensive with the top of the ribs 28 A/B and the end wall 42 A/B. In order to increase the length of the arms, to give them greater flexibility, a transverse slot 61 A/B is provided in the base 26 A/B contiguous with the arms 50 A/B and 52 A/B. This slot effectively increases the length of the arms and hence their ability to flex apart.

In order to ensure that the ribs do not interfere with the pivoting action of the two connectors 22A and 22B with respect to each other the top surface of the ribs contiguous with the flanges 28 is rounded or arcuate, e.g., constitutes an arc of 90° of a circle.

As can be seen clearly in FIGS. 1, 2, 3, 5 and 6 a cylindrical pin 60, having a domed free end, projects perpendicularly to the planar bottom surface 64 A/B of the base of each member 22 A/B. This projecting pin serves to key or locate the connector at a desired position on a printed circuit card (not shown) or other component (not shown) by fitting within a hole in the printed circuit card or other component at the desired position.

In order to hold the connector slightly off the surface of a printed circuit card plural domes standoffs 66 A/B are provided on the bottom surface 64 A/B of each body member. These standoffs thus enable the printed circuit card to be washed or flushed under the connector.

In accordance with a preferred embodiment of this invention, the body members 22 A/B are each molded as an integral unit of a tough, high temperature resistant, electrically insulative plastic, e.g., polyethylene terephthalate. One particularly effective polyethylene terephthalate is sold under the designation DP-3-1022 by Mobay Chemicals, although other suitable electrical insulating materials can also be used.

It should also be pointed out at this juncture that while the edges and corners of the body members 22 A/B are shown in the drawing herein as being relatively sharp, they are, in fact, radiused or rounded.

Referring now to FIGS. 1, 4, 5 and 6 the details of the plural contacts 30 A/B will now be discussed.

As can be seen each contact basically comprises three sections, namely, a cantilever section 68 A/B, a central or anchoring section 70 A/B, and a post or terminal section 72 A/B. Preferably, the contacts 30 A/B are each formed as an integral unit of an electrically conductive and suitably hard and durable material, e.g., berylium copper or phosphor bronze, and which is plated with a very thin coating of suitable material(s) such as gold over nickel. One particularly effective way of forming the contacts is by stamping them from a relatively thin, e.g., 0.006 inch, strip of such material so as to cut and bend the contact into the desired shape in an easy operation.

As can be seen the anchoring section 70 A/B constitutes the mid portion of the contact and is a relatively wide section having a pair of barbs 74 at its opposite ends. These barbs are provided to anchor the contact within a correspondingly shaped opening (see FIG. 5) in the member's base 26 A/B. The post portion 72 A/B of each contact is an elongated finger extending from one side of the anchor portion 70 A/B and is bent into a generally V-shaped cross-section along its length. This V-shape provides the post with substantial rigidity to serve as a terminal for connecting the contact 30 A/B to any desired electrical component. Thus, the post 72 A/B extends through a hole 76 A/B in the base 26 A/B of the member 22 A/B and projects substantially beyond the bottom wall 64 A/B thereof for connection to terminals on a printed circuit board (not shown) or some other device (not shown) to which the connector 20 is to be electrically connected.

The cantilever section 68 A/B of each contact 30 A/B is an elongated fingerlike projection extending in the opposite direction as the post 72 A/B from the anchoring portion 70 A/B. The cantilever portion 68 A/B basically comprises three sequentially located portions, namely, an arm portion 78 A/B, an engagement surface portion 80 A/B, and a free end or nose portion 82 A/B. The engagement surface 80 A/B in the preferred embodiment is generally planar and extends perpendicularly to the axis 24. The arm portion 78 A/B is also planar extends at a slight acute angle to the plane of portion 80 A/B and to the plane of anchoring portion 70 A/B. The nose or free end portion 82 A/B is also planar extends at a slight acute angle to the plane of the engagement portion 80 A/B and the anchoring portion 70 A/B.

The free end of nose portion 82 A/B is curved at 84 A/B to expedite the ready insertion of the contacts together, as will be described later.

As will be appreciated by those skilled in the art, with the contacts mounted as described the engaging surface portions 80 A/B of each contact is disposed in a plane tranverse to the longitudinal axis and contiguous therewith. When the two body members are connected together, the nose portions 82 A/B of their contacts engage each other first, causing them and their associated arm portions 78 A/B to flex. This action enables the engaging contacts to slide over each other until their engagement surfaces 80 A/B are disposed in contact with each other. The recess 41 A/B at the top of each rib provides a space into which the free end or nose of the associated contact may move to reduce the insertion force required to effect the securement of the contacts together.

In order to equalize the deflection of the arm and free end portions of the cantilever section of each contact and to provide for a low insertion force necessary to effect the ready connection of the two members 22 A/B together the free end of each of the contacts tapers from the contact surface 80 A/B to the free end 84 A/B. Moreover, the length of the arm portion 78 is longer than that of the free end portion 82 A/B to compensate for the increased flexibility provided by the reduced width nose portion. Thus, both the free end (nose) and arm portions of the contact deflect equally, to maintain the engaging surface 80A of each of contacts 38A parallel to the engaging surface 80B of each of contacts 30B.

As will be appreciated by those skilled in the art, by virtue of the fact that the electrical engagement of the contacts occurs at their planar portions 80A and 80B, which are relatively large in area and maintained parallel to each other, the current density through the contact area is kept sufficiently low. This feature greatly lessens the chance of galling or other surface damage to the contacts. In this connection, as is known, concentration of current through a small area of an electrical contact can result in galling (degrading) of the contact material and/or its plating. This problem is particularly acute if the contact surfaces are moved with respect to each other, such as in the case of a pivotable connector. By providing the enlarged contact areas through which the current passes, damage to the contact material, is minimized, if not obviated.

It should be pointed out at this juncture that the engaging surfaces need not be planar, if current density is not deemed a problem. Thus, the engaging surface 80A/B may be domed, or any other suitable shape. What is important is the use of the flexible free end (nose) and arm portions of the contact. Such elements enable one to use a relatively rigid engagement surface of any suitable shape while ensuring that the connector 20 exhibits low insertion and withdrawal forces for connecting and disconnecting its two members together.

As will be appreciated by those skilled in the art, of the low insertion and withdrawal forces which characterize the connector of this invention enable it to be constructed to include a large number of engaging contacts, e.g., 50 or more, and yet be readily connected and disconnected with minimum effort and without damage thereto.

Without further elaboration the foregoing will so fully illustrate my invention that others may, by applying current or future knowledge, adopt the same for use under various conditions of service.

I claim:

1. In an electrical connector comprising a pair of body members, each of said body members including:

plural spaced-apart ribs;

means for releasably securing said body members together with their ribs interleaved to define respective spaces between immediately adjacent interleaved ribs, said releasably securable means enabling said members to pivot through a predetermined angular range about a longitudinal axis extending through said interleaved ribs; and plural electrical contacts, wherein each of said contacts includes:

a post section extending out of said body member; an intermediate section connected to said post section; and an elongated cantilever section projecting from said body member in a direction towards said longitudinal axis so that when said members are secured together, the cantilever section of each contact of one member is disposed within a respective one of said spaces along with the cantilever section of a corresponding contact of the other member;

an improvement comprising:

(A) said intermediate section of said contacts comprises an anchoring section secured to said body member; and (B) said cantilever section of each of said contacts includes a free end portion, an intermediate portion defining an engagement surface, and an arm portion, said arm portion supporting said engagement surface at a position contiguous with said longitudinal axis, said free end portion and arm portion of said cantilever section being arranged to readily flex to facilitate the securement of said body members together, whereupon the engagement surfaces of the contacts of one body member engage the corresponding engagement surfaces of the contacts of the other body member in good electrical contact therebetween irrespective of the angular orientation of one body member to the other in said angular range.

2. The electrical connector of claim 1 wherein each of said engagement surfaces is generally planar and wherein said free end portion extends at a slight acute angle to the plane of said engagement surface and said arm portion also extends at a slight acute angle to the plane of said engagement surface.

3. The electrical connector of claim 2 wherein each of said cantilever sections is formed of a resilient material and configured to flex in a manner to ensure that the plane of the engagement surface of each contact of one member remains parallel to the plane of the engagement surface of the corresponding contact of the other member when the two body members are secured together.

4. The electrical connector of claim 3 wherein the plane of said engagement surfaces is essentially perpendicular to said longitudinal axis.

5. The electrical connector of claim 1 wherein said cantilever portion is formed from a strip of material and with said free end portion, engagement portion, and arm portion each being planar, but with the free end portion and said arm portion each extending at a slight acute angle to the plane of said engagement portion and with the width of said engagement portion and arm portion each being the same while the width of said free end portion tapers toward its free end and with the length of said arm portion being longer than said free end portion.

6. The electrical connnector of claim 5 wherein said free end portion includes an end curved out of the plane of the remainder thereof.

7. The electrical connector of claim 1 wherein each of said ribs is an elongated member extending generally transversely to said longitudinal axis and having a pair of ends, wherein said improvement further comprises an enlarged width flange portion formed on each end of each rib, with the spacing between the flanges of immediately adjacent ribs of each connector being just slightly larger than the width of said flange portions, whereupon when said members are secured together, the flange portions of the ribs of one member are disposed within and substantially fill the spaces between the flange portions of the ribs of the other member, thereby effectively isolating said spaces from the ambient atmosphere.

8. The improvement of claim 7 wherein each rib includes a top surface, with said top surface at only end of each of said ribs being arcuate.

9. The connector of claim 1 wherein each of said ribs includes a recess adjacent the top thereof into which said free end portion of an associated contact moves upon securement of the two body members together.

10. The electrical connector of claim 5 wherein each of said posts is generally V-shaped in cross section.

11. The electrical connector of claim 10 wherein each of said anchor sections includes barb means for fixedly securing said anchor portion of said contact to said body member.

12. The electrical connector of claim 5 wherein each of said electrical contacts is formed of a substantially hard and durable metal having good electrical conducting properties.

13. The electrical connector of claim 12 wherein said body member is molded of a high temperature resistant, good electrically insulative plastic material.

14. The electrical connector of claim 13 wherein said metal is selected from the group comprising beryllium copper and phosphor bronze and wherein said plastic material comprises polyethylene terephthalate.

15. The electrical connector of claim 1 wherein said means for releasably securing said two body members together comprises a recess disposed adjacent one end of each of said body members and a post disposed adjacent the other end of each of said body members, said post having an arcuate portion defining an arc of a circle of a predetermined radius and disposed concentrically about said longitudinal axis, said recess comprising at least one arcuate portion defining the arc of said circle of said predetermined radius and also disposed concentrically about said longitudinal axis, and wherein said improvement further comprises at least one relieved surface on said post contiguous with said arcuate surface whereupon said arcuate surface is less than an entire circle and its width is less than the diameter of said circle, whereupon the post of one body member may be readily snap-fit within the arcuate recess of the other body member, and vice versa.

16. The electrical connector of claim 15 wherein said recess also includes an entrance mouth portion and a stress-relief slot located below said arcuate portion, the improvement additionally comprising said stress relief slot being narrower in width than said entrance mouth, whereupon the interface of said stress relief slot and said arcuate portion of said recess serves as a stop surface to preclude the post from being inserted too deeply into said recess.

17. The electrical connector of claim 15 wherein said recess is formed between a pair of connecting arms, said improvement further comprising a transverse slot contiguous with said arms so that the length of each of said arms is greater than the length of each of said ribs although the top surfaces of said arms and said ribs are coextensive.

18. The electrical connector of claim 15 wherein each of said ribs is an elongated member extending generally transversely to said longitudinal axis and having a pair of ends, wherein said improvement further comprises an enlarged width flange portion formed on each end of each rib, with the spacing between the flanges of immediately adjacent ribs of each connector being just slightly larger than the width of said flange portions, whereupon when said members are secured together, the flange portions of the ribs of one member are disposed within and substantially fill the spaces between the flange portions of the ribs of the other member, thereby effectively isolating said spaces from the ambient atmosphere.

19. The improvement of claim 18 wherein each rib includes a top surface, with said top surface at only one end of each of said ribs being arcuate.

20. The connector of claim 19 wherein each of said ribs includes a recess adjacent the top thereof into which said free end portion of an associated contact moves upon securement of the two body members together.

21. The connector of claim 20 wherein said one body member includes at least one projection thereon to hold said body member slightly off said printed circuit board when it is connected thereto.

22. The connector of claim 1 wherein said predetermined angular range is from 0° to approximately 90°.

* * * * *